US011136094B2

(12) United States Patent
Wu

(10) Patent No.: US 11,136,094 B2
(45) Date of Patent: Oct. 5, 2021

(54) CONSTRUCTION METHOD FOR COLUMN PLATFORM BARREL DECK AND TOPSIDES, AND COLUMN PLATFORM

(71) Applicant: Zhirong Wu, Beijing (CN)

(72) Inventor: Zhirong Wu, Beijing (CN)

( * ) Notice: Subject to any disclaimer, the term of this patent is extended or adjusted under 35 U.S.C. 154(b) by 0 days.

(21) Appl. No.: 16/770,106

(22) PCT Filed: Jan. 18, 2019

(86) PCT No.: PCT/CN2019/072363
§ 371 (c)(1),
(2) Date: Jun. 5, 2020

(87) PCT Pub. No.: WO2019/141242
PCT Pub. Date: Jul. 25, 2019

(65) Prior Publication Data

US 2020/0346723 A1 Nov. 5, 2020

(30) Foreign Application Priority Data

Jan. 22, 2018 (CN) ..... 201810056942.X

(51) Int. Cl.
*B63B 35/44* (2006.01)
*B63B 73/00* (2020.01)

(52) U.S. Cl.
CPC ..... *B63B 35/44* (2013.01); *B63B 73/00* (2020.01)

(58) Field of Classification Search
CPC ..... B63B 35/44; B63B 73/00
See application file for complete search history.

(56) References Cited

U.S. PATENT DOCUMENTS 2,585,134 A * 2/1952 Kennedy ..... B63B 19/12 114/201 R
3,371,639 A * 3/1968 Schillreff ..... B63B 73/20 114/77 A
4,031,838 A * 6/1977 Schmidt ..... B63B 3/70 114/1
4,658,747 A * 4/1987 Franz ..... B63B 11/02 114/85

* cited by examiner

*Primary Examiner* — Stephen P Avila
(74) *Attorney, Agent, or Firm* — Arent Fox LLP; Michael Fainberg

(57) ABSTRACT

A construction method for a column platform barrel deck and topside facilities, and a column platform. The construction method includes: prefabricating topside facilities in form of modules one by one, lifting each module to a predetermined position on the topmost deck of the upright barrel, and then connecting the modules to each other and forming a module-integration bottom deck at the bottom; during construction of the upright barrel, a skylight opening is reserved on the barrel topmost deck for the installation of the topsides, and the skylight opening allows the modular-integration bottom deck to be placed inside; an on-site closing gap is formed between the edge of the skylight opening and the outer edge of the modular-integration bottom deck perimeter; using the on-site closing gap connection structures to fill the on-site closing gap, so that the modular-integration bottom deck and the barrel topmost deck jointly form an integrated platform deck.

10 Claims, 3 Drawing Sheets

CONSTRUCTION METHOD FOR COLUMN PLATFORM BARREL DECK AND TOPSIDES, AND COLUMN PLATFORM

RELATED APPLICATION

This application is the U.S. National Stage Application of International Patent Application No. PCT/CN2019/072363, filed on Jan. 18, 2019, which claims priority to Chinese Patent Application No. 201810056942.X, filed on Jan. 22, 2018, the contents of each of which is incorporated herein by reference in its entirety.

FIELD OF INVENTION

The present invention relates to the offshore engineering technical field, particularly to an integrated structure construction/design method for a fixed or floating column platform deck and topside facilities, and a column platform. The column platform is the shortened name of "upright (or straight) cylindrical platform".

TECHNICAL BACKGROUND

The current column platform is mainly related to cylindrical floating platform, particularly to cylindrical FPSO (Floating Production Storage and Offloading) and floating cylindrical drilling platform. The current column platform consists of three parts, see FIGS. 1 and 2: upright barrel (barrel for short) 1, topside facilities (topsides for short) 2 consisting of multiple modules and a few of non-modular typed independent equipment if any, and positioning system (not shown in the Figs). The barrel 1 is a watertight barrel formed by an upright outmost shell, a horizontal bottom plate and a horizontal top plate namely "main deck". The modules of the topsides 2 are installed on the main deck 1-2, or on a process deck 1-1 which is also a part of the barrel and installed above the main deck 1-2. The current construction/design method for the column platform is as follows: the barrel 1 and the modules of the topsides 2 are constructed separately, and the barrel 1 may has only one-layer of main deck 1-2 or simultaneously two-layer of the process deck 1-1 and the main deck 1-2, then the each module and the independent equipment is lifted and installed on the barrel topmost deck, and finally connected to each other, i. e., connecting the structures between the module bottom deck and the barrel topmost deck (note: the barrel topmost deck is the process deck 1-1 in FIG. 1, or the main deck 1-2 if the barrel without process deck).

Three significant shortcomings of the current construction/design method:

Firstly, see FIG. 1, the module bottom decks 2-1 are situated on the barrel topmost deck which forms a lot of partial two-layer decks with a clearance in-between; and the total overlapping areas of the two-layer decks are very large, which results in wasting steel and rising the center of gravity of the topside facilities in addition.

Secondly, each module, as an independent load, exerts on the barrel topmost deck; since the topmost deck has a large diameter and a large area, the barrel deck must have sufficient anti-bending strength and stiffness to bear said loads of the modules. Meanwhile the adjacent modules are isolated and not connected to each other by any horizontal structure except for module bottom deck 2-1 which is connected through the barrel topmost deck, especially the horizontal connection of the module upper layer decks (see FIGS. 1 and 2) are not connected to each other to make the topside facilities being as whole structure; further, although the height of each isolated module is quite high, it cannot form effective bending modulus together with the barrel topmost deck structures, so as to improve and optimize the structure of the barrel topmost deck, thus greatly increasing the bending stiffness and reducing the bending stress.

Thirdly, each module is installed independently on the barrel topmost deck, and the barrel deck becomes the only communication passage between the two adjacent modules, while the decks in other levels of the module are not connected with each other. As a result, workers to carry out inspection from one module to another must first climb from the bottom of the first module to the upper level and then down back to the bottom deck, and then up and down another module by the way of the barrel topmost deck, which is not conducive to inspection, maintenance, material transport, life-saving and escape; In addition, each module must be equipped with two stairways, and the perimeter of each module deck must be equipped with passageways and railings, which cannot be shared with adjacent modules, thus wasting both space and materials.

As such, this application inventor developed an integrated structure construction/design method for column platform deck and topside facilities, and a column platform based on the core technology of said integration method. The topsides are constructed/installed in form of multiple modules, then connected with each other to form one piece of whole structure namely "module-integration", wherein each module bottom deck connected to each other to form a module-integration bottom deck. The module-integration bottom deck is situated in a large-diameter opening (skylight opening) of the barrel topmost deck then connected with it together. The module-integration bottom deck and the barrel topmost deck are combined and become two-in-one to form one piece of an integrated platform deck, to overcome the shortcomings of the current design/construction method.

SUMMARY

The invention discloses an integrated structure construction/design method for column platform deck and topside facilities, and a fixed or a floating column platform; the topsides are installed on the barrel topmost deck, and the barrel topmost deck is the main deck if the barrel deck is a single deck, or installed on the process deck which is mounted above the main deck.

The invention provides a construction method for the column platform deck and topsides, which includes the following steps:

S10. The topside facilities are prefabricated in form of modules one by one, then the modules are lifted one by one to the predetermined position of the barrel topmost deck, and then the modules are connected to each other as a whole to form a module-integration, and one piece of module-integration bottom deck is formed at the bottom;

S20, when the barrel is constructed, a skylight opening is reserved on the barrel topmost deck for the installation of the topsides, and the skylight opening allows the modular-integration bottom deck to be placed inside; an on-site closing gap is formed between the edge of the skylight opening and the outer edge of the modular-integration bottom deck perimeter;

S30, using the on-site closing gap connection structure to fill the on-site closing gap, so that the modular-integration bottom deck and the barrel topmost deck jointly form an integrated platform deck.

Described further, described in S20, the barrel construction also includes steps: according to the predetermined position for said each module on the barrel topmost deck, some permanent and/or temporary support structures to support said each module are installed underneath the skylight opening, and the permanent and/or temporary support structures are constructed together with the barrel, of which the temporary support structures shall be dismantled after the whole platform construction finished.

Described further, described in S10, the modules connected to each other as a whole framework to form a module-integration includes steps: after each module is prefabricated, the modules are lifted and fixed on the tops of said permanent and/or temporary support structures, and then through the on-site connections between modules to form a whole module-integration, of which said each module bottom deck connecting to each other to form one piece of module-integration bottom deck.

Described further, described in S10, said each module can be a complete module for lifting independently, or can be a segmentation module through "cutting" the pre-designed integration-module into multiple temporary segmentation modules. During prefabrication of each segmentation module, some temporary connection structures must be equipped to make the segmentation module form a complete temporary structural frame for lifting independently, of which the temporary connection structures shall be dismantled upon completion of module-integration construction.

Further, the finite element modeling scope for the structural calculation of the barrel suitable for the integrated construction method includes: the barrel itself, and the module-integration bottom deck which is simulated to "cut" from the module-integration, or as an alternative, and the whole structure of the module-integration. The simulated cutting method is to "cut off" sections of the structural column/diagonal brace on the top surface of the modular-integration bottom deck, and to use the internal forces on the sections calculated from the module-integration structural analysis as external forces, together with the loads borne by the module-integration bottom deck to input into the finite element analysis/calculation model of the barrel.

The invention also provides a column platform, the main body of which includes:

An upright barrel with barrel deck, wherein a skylight opening is reserved on the deck for installing topside facilities;

Topside facilities (topsides for short), which comprise a plurality of modules connected to each other to form a module-integration and a module integration-bottom deck is formed at the bottom; the skylight opening allows the module-integration bottom deck to be placed inside; an on-site closing gap is formed between the edge of the skylight opening and the outer edge of the module-integration bottom deck perimeter;

On-site closing gap connection structures, which are connected at the on-site closing gap so that the module integration bottom deck and the barrel deck jointly form an integrated platform deck.

Further, the barrel deck is a single deck or a double deck, wherein the single deck is sole barrel main deck and the double deck consists of barrel main deck and barrel process deck which is mounted above the main deck. The topsides are installed on the barrel topmost deck which is the main deck of the single deck or the process deck of the double deck.

Further, the on-site closing gap connection structures comprising many beams/girders, stiffeners and plates filling in the gap, which connect the barrel topmost deck and the module-integration bottom deck. As a result, the two top surfaces of said two decks are combined as two-in-one and become a same top surface with a same elevation to form an integrated combined platform deck.

Described further, each module in the module-integration can be a complete module for lifting independently, or can be a segmentation module through "cutting" the pre-designed module-integration into multiple temporary modules. The design/construction work of each segmentation module shall include the design/construction work of some temporary structures needed during prefabrication to make said module form an integrated temporary framework structure, and to ensure said temporary module can be lifted independently. The temporary structures shall be dismantled upon completion of module-integration construction.

Further, some permanent and/or temporary support structures to support said each module are installed underneath the skylight opening, and the temporary support structures shall be dismantled after the entire platform construction finished.

The basic thinking of the design of this invention is that, under the principle of integrated overall design of the platform, the overall planning of the topsides and the barrel is unified, and the work division/interface between the barrel designer and the topsides designer are clarified at different stages, so as to finally realize the optimized structural design of the entire platform.

The construction method for the barrel deck and topsides of this invention can be used for a floating column platform or a fixed column platform seated on seabed. The invention overcomes the shortcomings of the structure design and construction method for the current column platform, optimizes the structure design and construction and installation procedures, reduces the amount of steel used, facilitates the construction, is conducive to the safety of production operation, and has the advantages of reducing the platform cost and operation cost.

BRIEF DESCRIPTION OF THE DRAWINGS

The appended drawings described herein are for explanatory purposes only and are not intended in any way to limit the scope of disclosure of the invention.

DETAILED DESCRIPTION

The details of the invention can be understood more clearly by combining the attached drawings and the description of the specific implementations of the invention. However, the specific embodiments of the invention described herein shall be used only for the purpose of explaining the invention and shall not be construed in any way as a limitation of the invention.

The invention discloses a construction method for the upright barrel deck and topside facilities of a column platform, and a column platform. The construction method of the invention is applicable to a floating or fixed column platform.

Figure 3:
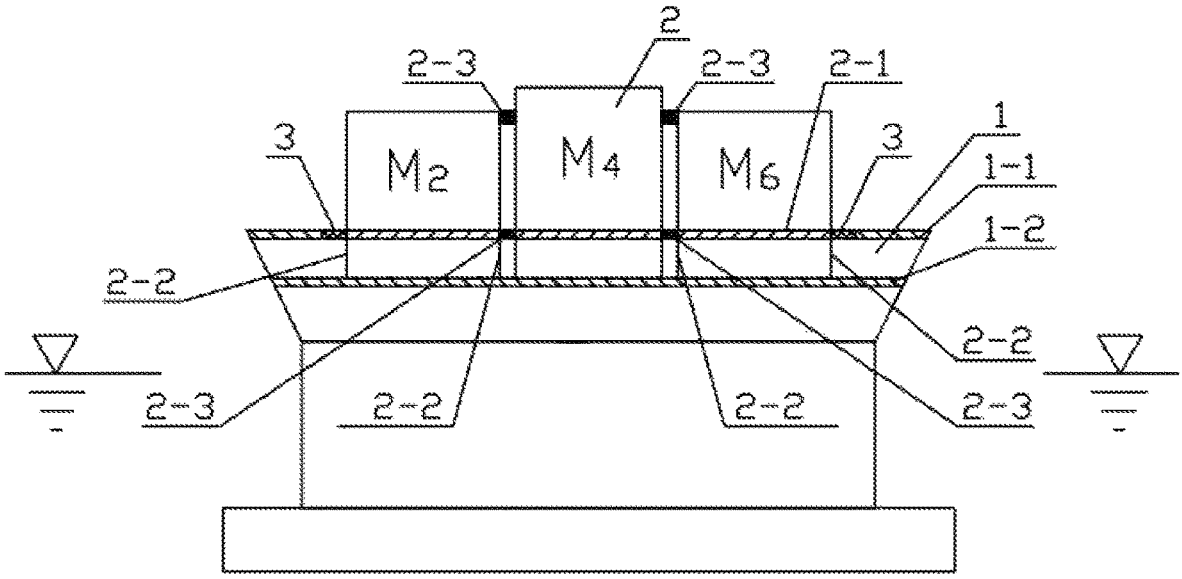
FIG. 3 is the elevation diagram of the column platform of this invention, showing the state of construction completion using the integrated construction method for the barrel deck and the topsides structure.
Figure 4:
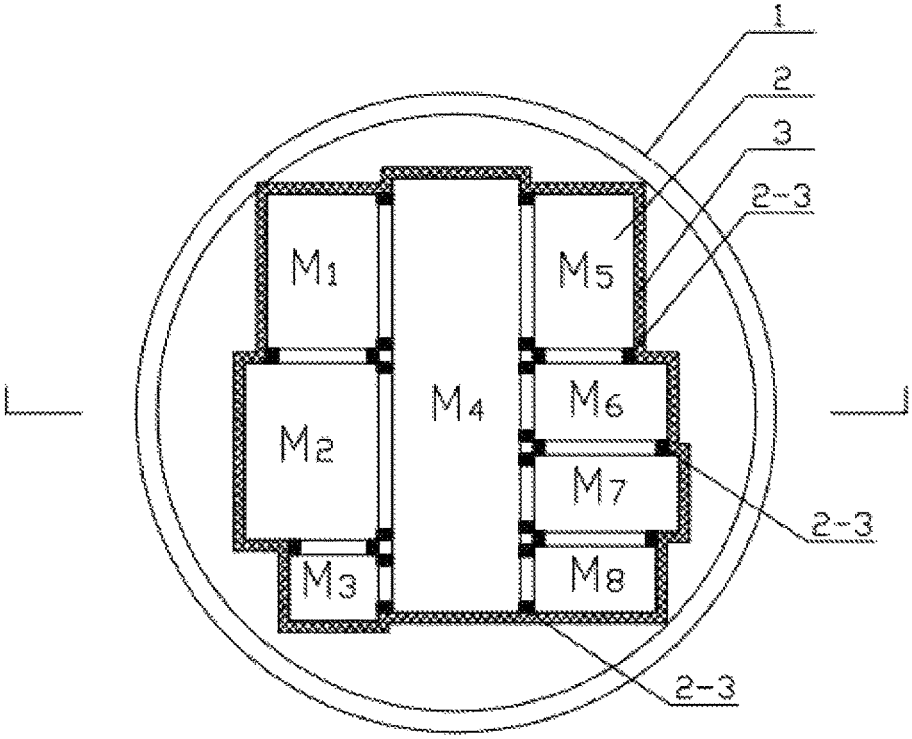
FIG. 4 is the structure schematic diagram of the top view of FIG. 3.

Refer to FIG. 3 and FIG. 4. The main body of the platform is composed of three parts: upright barrel (barrel for short) 1, topside facilities (topsides for short) 2 and on-site closing gap connection structure (gap connections for short) 3.

The barrel 1 is an upright watertight structure, which is specifically formed by an upright outmost cylinder shell, a horizontal bottom plate at the bottom and a horizontal plate (main deck 1-2) at the top; The deck of the barrel 1 can be a single barrel main deck 1-2 (i.e., one-layer of single deck), or a two-layer of double deck consisting of the barrel main deck 1-2 and the barrel process deck 1-1 mounted above the main deck (as shown in FIG. 3). The topsides 2 are installed on the topmost deck of barrel 1, that is, barrel main deck 1-2 (if the barrel is not provided with a barrel process deck 1-1), or barrel process deck 1-1 (if the barrel is provided with a double deck as shown in FIG. 3).

Figure 1:
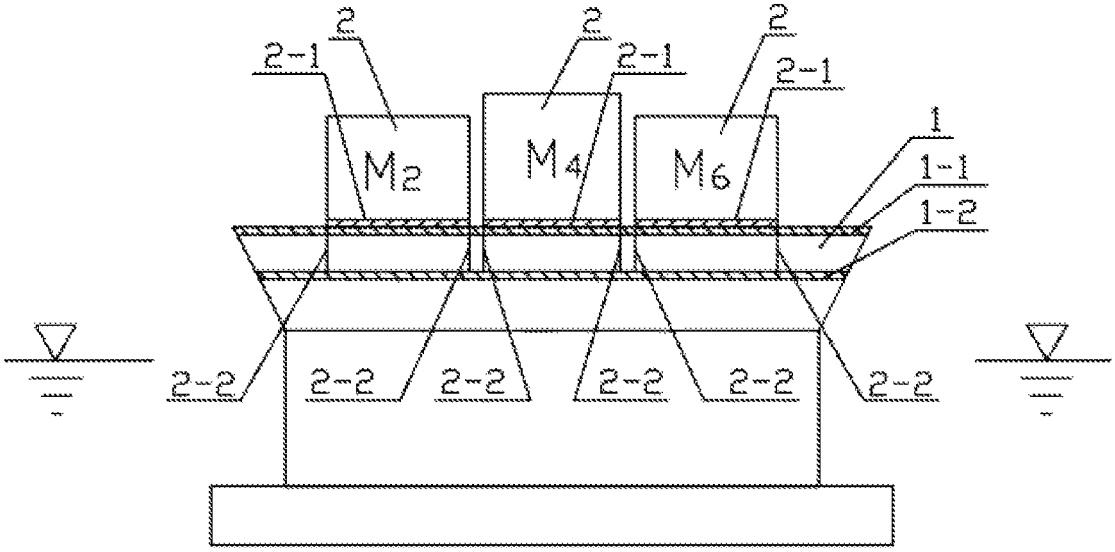
FIG. 1 is the elevation diagram of the column platform with prior art, showing the state of construction completion using the current construction method.
Figure 2:
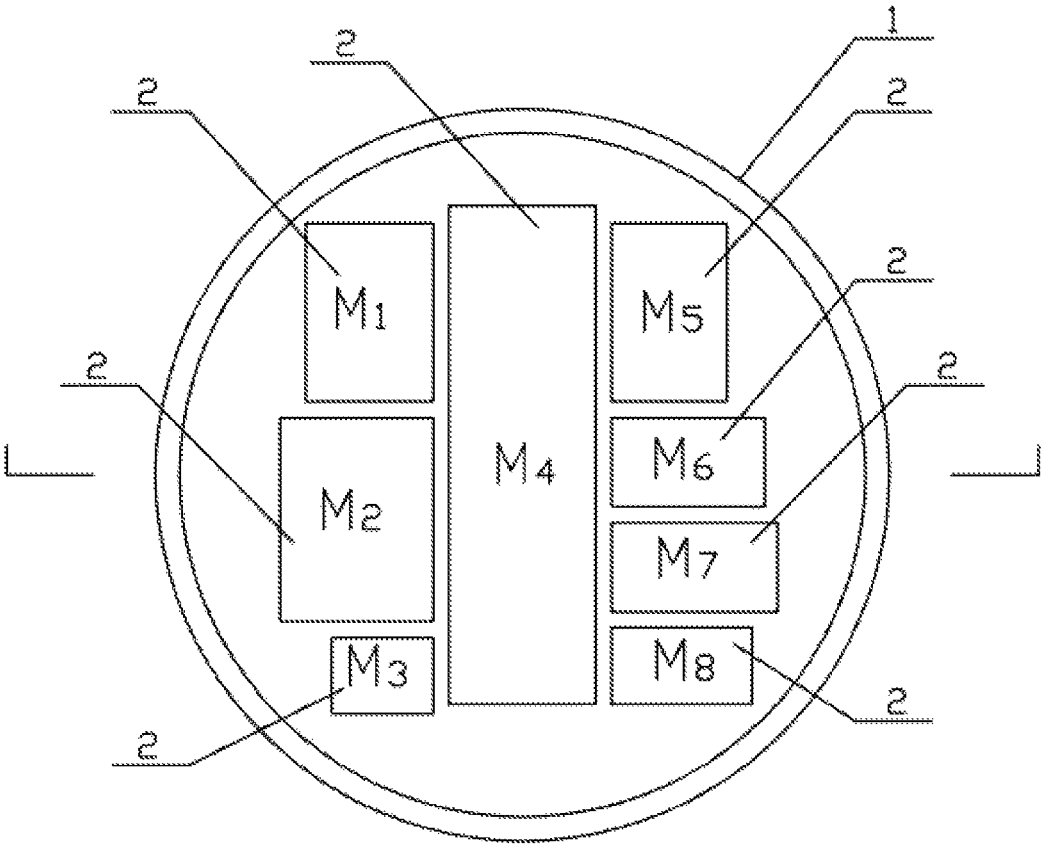
FIG. 2 is the structure schematic diagram of the top view of FIG. 1.

Topsides 2 shall consist of at least one or more modules, and maybe one or more individual equipment or installations in form of non-module (not shown in the attached drawings). The modules are as M1-M8 shown in FIG. 3 and FIG. 4 (the number of modules is determined according to needs; the module number of "8" in FIG. 1 and FIG. 4 are only examples). The module definition of the present invention means a structure consisting of a one-layer or multi-layer deck (generally referred to as the "module deck", and its bottom deck called "module bottom deck 2-1"). Multiple devices/systems are installed on said module deck (including module bottom deck 2-1) to realize some special functions, and said module is named according to its function, such as oil and gas processing module, water processing module, power module, thermal station module, and so on. From the angle of the structure, each module mentioned in the present invention can be a complete module with complete framework structure suitable for lifting independently (as shown in FIG. 3 and FIG. 4), or can be a segmentation module through "cutting" the pre-designed integration-module into multiple temporary modules (not shown in the appended drawings). During design and prefabrication of each segmentation module, some temporary frame/connection structures must be equipped to make said segmentation module form a complete structural framework for lifting independently, of which the temporary frame/connection structures will be dismantled after the whole module-integration construction finished. The modules are connected to each other through the module deck on-site connection structures (module on-site connections 2-3 for short, shown in FIG. 3 and FIG. 4) as a whole, i. e., forming a module-integration (not identified in the attached figure); In particular, the module bottom deck 2-1 in the module-integration is connected to each other through a plate and beam structure (i.e., the module on-site connections 2-3 between adjacent module bottom decks as shown in FIG. 3) to form a monolithic module-integration bottom deck (not identified in the attached drawings).

A skylight opening is reserved on the barrel topmost deck on which the topsides 2 are installed; The skylight opening allows the module-integration bottom deck to be placed inside and an on-site closing gap is formed between the edge of the skylight opening and the outer edge of the module-integration bottom deck perimeter.

The on-site closing gap connection structures (gap connections 3 for short) connect the on-site closing gap, so that the module-integration bottom deck and the barrel topmost deck are combined as two-in-one and form an integrated platform combination deck together.

The basic steps of the integrated construction method for the column platform barrel deck and the topsides are as follows:

The barrel 1 and the topsides 2 will be constructed and prefabricated in the dry dock and shipyard site respectively.

The topsides 2 are prefabricated in form of modules one by one on site, then the modules are lifted and fixed one by one to the predetermined position of the barrel topmost deck, and then the modules are connected to each other through the module on-site connections 2-3 between each layer deck of the adjacent modules as shown in FIG. 3 and FIG. 4, eventually to form a whole structure of the module-integration. Equipment, cables and accessories inside each module shall be prefabricated and installed as far as possible so as to reduce the workload after the modules installed on the barrel topmost deck.

When the barrel is constructed, a skylight opening is reserved on the barrel topmost deck, which means the partial deck within the skylight opening scope of the barrel topmost deck will not be constructed. The opening position of the skylight opening corresponds to the position of the module-integration bottom deck, and the plane geometry of the skylight opening is similar to the plane geometry of the module-integration bottom deck, but the size of the skylight opening is slightly larger, that is, the skylight opening allows the module-integration bottom deck to be placed inside; an on-site closing gap is formed between the edge of the skylight opening and the outer edge of the modular-integration bottom deck perimeter.

According to the predetermined position for each module in the barrel topmost deck, some permanent and/or temporary support structures 2-2 are installed underneath the skylight opening to support said each module, so that each module can be lifted, installed and fixed on the top of the permanent and/or temporary support structure 2-2 corresponding the predetermined position in the barrel topmost deck. The permanent and/or temporary support structures 2-2 are constructed together with the barre 1.

After the work of lifting and fixing each module is completed, then complete the module on-site connections 2-3 between adjacent modules as shown in FIG. 3 and FIG. 4, so that all modules are connected as a whole structure to form a module-integration. It includes: connections of adjacent module bottom decks 2-1 to form a large and integral module-integration bottom deck, connections between adjacent each layer deck above module bottom deck and/or connections of some module topmost structure with its adjacent module structure, where the adjacent module decks with same or similar elevation shall be joined and connected with each other. The connection of piping and cabling among adjacent modules will be finished after the structural connection of module-integration completed.

Closing the on-site closing gap between the module-integration bottom deck and the barrel topmost deck. After the completion of the module on-site connections 2-3 between modules, the on-site closing gap exists between the module-integration bottom deck and the skylight opening. The gap connections 3 as shown in FIG. 3 and FIG. 4 is adopted to fill the on-site closing gap and complete the skylight opening closing. The gap connections 3 comprise: beams/girders, stiffeners needed to connect the circumjacent deck around the skylight opening and the module-integration bottom deck, as well as a flat plate to fill the on-site closing gap. In other words, the skylight opening is finally filled by the module-integration bottom deck and the gap connection 3, so that the module-integration bottom deck and the barrel deck on which the module-integration bottom deck is located are integrated and combined as two in one, jointly forming an integrated platform deck with a same top surface elevation.

Finally, one or more non-module typed and individual equipment or devices, if any, are installed on the barrel deck, then remove all temporary support structures and/or temporary connection structures, including the temporary support structure 2-2 under the module bottom and the temporary frame/connection structure of the segmentation module to complete the construction of the entire platform.

The basic thinking of the design of this invention is that the design of the barrel 1 and the topsides 2 is performed by different designers respectively, and under the principle of integrated overall design of the platform, the overall planning of the topsides and the barrel is unified, and the work division/interface between the barrel designer and the topsides designer are clarified at different stages, so as to finally realize the optimized structural design of the entire platform.

The division and interface of design between the barrel designer and the topsides designer shall be carried out in different stages.

In the first stage, the barrel designer and topsides designer will perform the preliminary calculation/analysis and concept design for the barrel (with skylight opening) and the topsides respectively, then exchange the design results to each other, among them, the module-integration must be planed and designed the as a whole structure, the technical requirement and preliminary calculation/design scheme of the permanent support structure and/or the temporary support structure of 2-2 shall be carried out by the topsides designer, then submitted to the barrel designer; The barrel designer shall review and, if necessary, modify the preliminary design scheme of the module-integration bottom deck of the topsides according to the requirements of the integrated whole deck.

In the second stage, the barrel designer and the topsides designer shall complete the structure detailed design of the barrel 1 and the topsides 2 respectively. Among them, the integrated platform deck, as a whole deck, including the module-integration bottom deck, the circumjacent barrel topmost deck around the skylight opening, as well as the gap connections 3, plus the permanent support structure and/or temporary support structure 2-2 underneath the skylight opening shall be in the scope of the detained analysis/calculation of the barrel to be done by the barrel designer.

The finite element modeling scope for the detailed analysis and calculation of the barrel structure includes, in addition to the barrel itself, the structure of the entire topsides, or only the structure of the module-integration bottom deck which is cut and separated by simulation. The simulated cutting method is to "cut off" sections of the structural columns/diagonal braces on the top surface of each module bottom deck 2-1, and to use the internal forces on the sections calculated from the topsides structural analysis as external forces, together with the loads borne by each module bottom deck 2-1, to be input into the model.

The invention also provides a column platform (see FIG. 3 and FIG. 4), the main body of which includes three parts as follows: upright barrel 1 (barrel for short), topside facilities 2 (topsides for short) and on-site closing gap connection structures 3 (gap connections for short).

A barrel 1, which is a watertight barrel formed by an upright outmost shell, a horizontal bottom plate and a horizontal top plate with a single deck or a double deck; said double deck of the barrel comprises a main deck 1-2 (i.e., the horizontal top deck) and a process deck 1-2 mounted above the main deck as shown in FIG. 3; said single deck of the barrel is the barrel horizontal bottom plate i.e., the main deck 1-2; the topsides are installed on the topmost deck of the barrel, and the topmost deck is the main deck 1-2 of the barrel with single deck or the process deck 1-1 of the barrel with double deck. A skylight opening is reserved on the barrel topmost deck.

Topsides 2, which shall consist of at least one or more modules, and maybe one or more individual equipment or installations in form of non-module (not shown in the attached drawings). The modules are connected to each other to form a module-integration and a module-integration bottom deck is formed at the bottom; the skylight opening allows the module-integration bottom deck to be placed inside; an on-site closing gap is formed between the edge of the skylight opening and the outer edge of the module-integration bottom deck perimeter.

Gap connection structures 3, which are connected at the on-site closing gap so that the module integration bottom deck and the barrel topmost deck jointly form an integrated platform deck.

In addition to the main body, the column platform of the invention also comprises a mooring positioning system and/or a dynamic positioning system required for the floating column platform of the invention, or a seabed infrastructure required for the fixed column platform seated on the seabed; Said positioning system or infrastructure have a number of mature technical schemes available for optional use, therefore, the technical content of the invention does not relate to them.

The barrel 1 and the modules of the topsides 2 are constructed and prefabricated in the shipyard and site respectively. After the prefabrication of one or more modules is completed, they are then lifted one by one to a predetermined position on the barrel deck and then connected as a whole to form a module-integration; Among them, the decks with the same or similar elevation of each adjacent module are connected with each other, and each module bottom deck 2-1 is connected with each other to form an module-integration bottom deck.

When the barrel 1 is constructed, the partial deck within the skylight opening scope of the barrel topmost deck will not be constructed. The opening position of the skylight opening corresponds to the position of the module-integration bottom deck, and the plane geometry of the skylight opening is similar to the plane geometry of the module-integration bottom deck, but the size of the skylight opening is slightly larger; An on-site closing gap is formed between the edge of the skylight opening and the outer edge of the modular-integration bottom deck perimeter.

According to the predetermined position for each module in the barrel topmost deck, some permanent and/or temporary support structures 2-2 are installed underneath the skylight opening to support said each module, so that each module can be lifted, installed and fixed on the top of the permanent and/or temporary support structures 2-2 corresponding the predetermined position in the barrel topmost deck. The permanent and/or temporary support structures 2-2 are constructed together with the barre 1, of which, the temporary support structure shall be dismantled upon completion of platform construction.

Each module within the module-integration can be a complete module for lifting independently, or can be a segmentation module through "cutting" the pre-designed integration-module into multiple temporary modules. Each segmentation module is provided with a temporary connection structure required for prefabrication and lifting, so that the segmentation module forms a complete temporary frame structure to ensure that the segmentation module can be independently lifted. The temporary connection structure shall be dismantled after the completion of the module-integration construction.

The gap connection 3 comprises: beams/girders, stiffeners needed to connect the circumjacent deck around the skylight opening of the barrel topmost deck and the module-integration bottom deck, as well as a flat plate to fill the on-site closing gap, so that the module-integration bottom deck and the barrel topmost deck are integrated and combined as two in one, jointly forming an integrated and combined platform deck with a same top surface elevation. Finally, one or more non-module typed and individual equipment and/or devices, if any, are installed on the barrel deck, then remove all temporary support structures and/or temporary connection structures to complete the construction of the entire platform.

Under the principle of integrated overall design of the platform of the invention, the barrel designer and the topsides designer shall have a unified overall planning, work-division and interface cooperation, and organic transmission/connection so as to finally realize the optimized structural design of the entire platform. Compared with the structure design/construction method for the current column platform, the present invention overcomes its shortcomings, realizes the design optimization and construction installation program optimization, especially the optimization of the overall structure, the bending stiffness of the integral structure of barrel and topsides is very high, the force transmission paths of the support structures under topsides are concise and clear; the module-integration bottom deck and the barrel topmost deck are combined as two in one; the amount of steel is reduced notably, and the center of gravity of the topsides descends slightly at the same time; The adjacent module decks are connected, passageways and stairways are designed in a unified way for entire module-integration to realize the sharing of structure and space, which is conducive to inspection, maintenance, material transport, life-saving and escape, and improves the safety of production operation, as well as easy to build; Finally, it will reduce the construction cost, construction time schedule and production operation cost of the platform.

The invention claimed is:

1. A construction method for column platform barrel deck and topsides, comprising:

S10, topside facilities are prefabricated in form of modules one by one, and the modules are lifted one by one to the predetermined position of the barrel topmost deck, and then the modules are connected to each other as a whole to form a module-integration, and one piece of module-integration bottom deck is formed at the bottom;

S20, when the barrel is constructed, a skylight opening is reserved on the barrel topmost deck for the installation of the topsides, and the skylight opening allows the modular-integration bottom deck to be placed inside; an on-site closing gap is formed between the edge of the skylight opening and the outer edge of the modular-integration bottom deck perimeter; and S30, using the on-site closing gap connection structures to fill the on-site closing gap, so that the modular-integration bottom deck and the barrel topmost deck jointly form an integrated platform deck.

2. The construction method for column platform barrel deck and topsides according to claim 1, wherein in step S20, the barrel construction also includes steps: according to the predetermined position for said each module in the barrel topmost deck, some permanent and/or temporary support structures to support said each module, are installed underneath the skylight opening, and the permanent and/or temporary support structures are constructed together with the barrel, of which the temporary support structures shall be dismantled upon completion of the construction of the entire platform.

3. The construction method for column platform barrel deck and topsides according to claim 2, wherein in step S10, said modules connected to each other as a whole framework to form a module-integration includes steps: after each module is prefabricated, the modules are lifted and fixed on the tops of said permanent and/or temporary support structures, and then through the on-site connections between modules to form a whole module-integration, of which said each module bottom deck connecting to each other to form one piece of module-integration bottom deck.

4. The construction method for column platform barrel deck and topsides according to claim 1, wherein in step S10, said each module can be a complete module for lifting independently, or can be a segmentation module through "cutting" the pre-designed integration-module into multiple temporary segmentation modules, during prefabrication of each segmentation module, some temporary connection structures must be equipped to make the segmentation module form a complete temporary structural frame for lifting independently.

5. The construction method for column platform barrel deck and topsides according to claim 1, wherein the finite element modeling scope for the structural calculation of the barrel suitable for the integrated construction method includes: the barrel itself, and the module-integration bottom deck which is simulated to "cut" from the module-integration, or as an alternative, and the whole structure of the module-integration; the simulated cutting method is to "cut off" sections of the structural column/diagonal brace on the top surface of the modular-integration bottom deck, and to use the internal forces on the sections calculated from the module-integration structural analysis as external forces, together with the loads borne by the module-integration bottom deck, to input into the model calculated by finite element analysis of the barrel.

6. A column platform, wherein a main body of the column platform comprises three parts: an upright barrel, topside facilities and on-site closing gap connection structures;

the upright barrel with barrel deck, wherein a skylight opening is reserved on the deck for installing the topside facilities;

topside facilities, which comprise a plurality of modules connected to each other to form a module-integration and a module integration-bottom deck is formed at the bottom; the skylight opening allows the module-integration bottom deck to be placed inside; an on-site closing gap is formed between the edge of the skylight opening and the outer edge of the module-integration bottom deck perimeter; and on-site closing gap connection structures, which are connected at the on-site closing gap so that the module integration bottom deck and the barrel deck jointly form an integrated platform deck.

7. The column platform according to claim 6, wherein the barrel deck is a double deck or a single deck: the double deck is composed of the barrel main deck and the barrel process deck mounted above the main deck, and the single deck is a single barrel main deck; the topside facilities are installed on the barrel topmost deck, which is the barrel main deck of the single deck, or the barrel process deck of the double deck.

8. The column platform according to claim 6, wherein the on-site closing gap connection structures comprising a plurality of beams/girders, stiffeners and plates filling in the gap, which connect the barrel topmost deck and the module-integration bottom deck, so that the two top surfaces of said two decks are combined as two in one to form an integrated combined platform deck with a same top surface and a same elevation.

9. The column platform according to claim 6, wherein each module in the module-integration is a complete module for lifting independently, or a segmentation module through "cutting" the module-integration into multiple temporary complete modules; a plurality of temporary structures needed during prefabrication are provided and installed to make said module form an integrated temporary framework structure, and to ensure said temporary complete module can be lifted independently.

10. The column platform according to claim 6, wherein a plurality of permanent and/or temporary support structures to support said each module are installed underneath the skylight opening.

* * * * *